United States Patent [19]

Brush, Sr. et al.

[11] Patent Number: 4,468,077

[45] Date of Patent: Aug. 28, 1984

[54] ELECTRICAL CONNECTOR ASSEMBLY HAVING AN ANTI-DECOUPLING DEVICE

[75] Inventors: Robert W. Brush, Sr., Unadilla; Dee A. Werth, Afton, both of N.Y.

[73] Assignee: The Bendix Corporation, Southfield, Mich.

[21] Appl. No.: 431,994

[22] Filed: Sep. 30, 1982

[51] Int. Cl.[3] ..... H01R 13/629

[52] U.S. Cl. ..... 339/89 M; 339/DIG. 2

[58] Field of Search ..... 339/DIG. 2, 90 R, 90 C, 339/89 R, 89 C, 89 M; 285/82, 84, 86, 87, 92; 411/296, 299, 300

[56] References Cited

U.S. PATENT DOCUMENTS 4,257,663 3/1981 Brush et al. ..... 339/89 M 4,272,144 6/1981 Brush et al. ..... 339/89 R

*Primary Examiner*—John McQuade

*Attorney, Agent, or Firm*—Charles D. Lacina; Raymond J. Eifler

[57] ABSTRACT

A plurality of longitudinally housed looped spring members (340) are pivotally supported by a wire (350) circumposed about a plurality of ratchet teeth (150) defining a contiguous succession of longitudinal peaks and valleys (154, 152) for interengagement, the spring members including a straight end portion (342) advanced around the peaks and valleys and a curved end portion (344) normally out of engagement with the ratchet teeth, the wire being supported in an annular groove (331) of a coupling nut (300) rotatably mounted to one shell (100) of an electrical connector assembly comprising a pair of shells (100, 200), the forward end face (222) of the second shell being drawn against the curved end portion (344) to drive the straight end portion (342) downwardly into the ratchet teeth when mating engagement has been achieved, the bias of the straight end portions (342) resisting rotation of the coupling nut.

10 Claims, 7 Drawing Figures

ELECTRICAL CONNECTOR ASSEMBLY HAVING AN ANTI-DECOUPLING DEVICE

This invention relates to an electrical connector assembly having an anti-decoupling device and, more particularly, to electrical connectors provided with means for resisting unwanted uncoupling rotation of a coupling nut.

Coupling mechanisms which resist uncoupling rotation of a coupling nut as a result of vibration are known. In "Electrical connector Assembly Having an Anti-Decoupling Mechanism" U.S. Pat. No. 4,109,990 issuing Aug. 29, 1978 to Waldron et al., an electrical connector assembly is disclosed wherein a chordal spring beam is mounted on the coupling nut and includes a medial tooth member coacting with ratchet teeth carried on a radial flange extending from the connector shell. A major limitation of this type of mechanism is that spring forces constantly wear against the contacted members. Use of such springs and coacting ratchet teeth require that the coating parts have close tolerances to provide efficient and sure contacts therebetween. Wearing of the teeth or spring element also can be troublesome following repeated coupling and uncoupling of the connectors. Generally, a plurality of the chordal springs are provided which results in additional cost in the fabrication of the springs. Fixation of the springs about the coupling nut could introduce debris and burrs.

This invention provides an anti-decoupling device which promotes locking of the coupling nut relative to its associated plug shell only after a connectable receptacle shell has achieved a substantially full mate with the plug shell. More specifically, the anti-decoupling device comprises a coupling nut, a plurality of generally equiangularly spaced spring members of the type including an apertured support portion intermediate oppositely extending first and second hooked end portions thereof, each spring member being protectively mounted within like support housings disposed around the connector shell, the first hooked end portion being disposed and normally in engagement within successive of the ratchet teeth and the second hooked end portion being disposed so as to be normally out of engagement with the ratchet teeth and having its end adapted to be engaged with by the front face of the second shell when full mate is achieved, engagement compressing the second hooked end portion of the spring member rearwardly and driving the first hooked end portion downwardly into compression into its respective ratchet tooth valley, each spring member being mounted to the coupling nut by a support wire in a fashion that allows the spring members to laterally sway or pivot relative to their securement wire and be deflected from tooth-to-tooth until the full mate position is nearly achieved.

The present invention also provides an efficient anti-decoupling device that has fewer parts and is easily manufactured using a minimum of manufacturing steps. One advantage of this invention is that a continuous support wire easily positions a plurality of apertured spring members by being passed through successive apertures and provides a support giving each spring freedom of lateral movement until nearly full mate is achieved. Further, a plurality of each spring member is inexpensive yet provides effective biased fitment within its respective ratchet tooth valley to thereby lock the coupling nut to the shell in preventing uncoupling during vibration.

One way of carrying out the invention is described in detail below with reference to the drawings which illustrate one specific embodiment of this invention, in FIG. 1 illustrates partially in section a disassembled electrical connector assembly including a coupling nut having an anti-coupling device.

Figure 1:
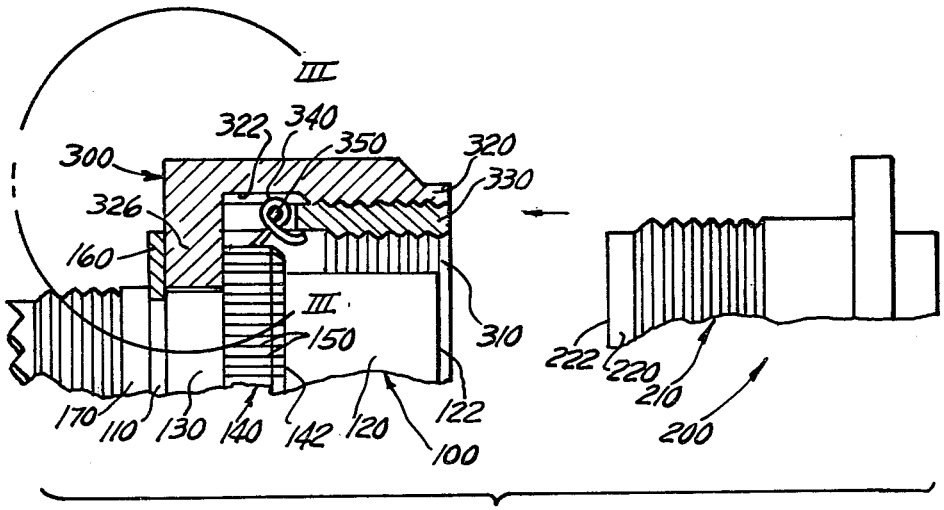

Referring now to the drawings, FIG. 1 shows an electrical connector assembly according to the present invention in which includes a first shell 100, a second shell 200 are positioned for mating engagement and a coupling nut 300 that is mounted to the first shell for connecting the first shell and the second shell in mating relationship.

The first shell 100 comprises a front portion 120, a rear portion 170 and radial shoulder 140 medially of the shell portions, rear portion 170 including a stepped groove 110 and an annular groove 130 adjacent the radial shoulder. The radial shoulder 140 includes a front face 142 and includes on its outer circumferential surface a plurality of ratchet teeth 150 defined, respectively, by a contiguous succession of peaks and valleys 154, 152 with a tapered forward face 156 thereof, being tapered relative to the primary axis of the shell and forming a rearward continuation of the front face 142. Typically the first shell would be characterized as a plug connector and, although not shown, would include one or more female-type (i.e. socket) electrical contacts retained within the shell by dielectric inserts. The outer surface of the shell would include one or more keys for orienting the first shell relative to the second shell.

The second shell 200 comprises a front portion 220 including on an outside surface thereof thread means 210 and having a front face 222. Further, the second shell 200 would be characterized as a receptacle connector and, although not shown, typically includes one or more axially extending recesses or keyways for receiving the respective keys on the first shell and one or more male-type (i.e. pin) electrical contacts that mate within the socket-type contacts of the first shell, the pin contacts being retained in dielectric inserts mounted in the shell.

The coupling nut 300 is rotatably mounted over rear portion 120 of the first shell 100 and includes internal threads 130 adapted to mate with the external threads 210 on the second shell 200 to bring the first and second shells together with the contacts mated. As shown, a radial flange 326 is adapted to be received within the annular groove 130 and captivated for rotation against the radial shoulder 140 and retained thereagainst by a retaining ring 160 snapped within the stepped groove 110 on the rear portion of the first shell. Rotation of coupling nut 300 axially advances the first shell front portion inwardly into the second shell front portion the second shell front portion inwardly of the coupling nut front portion with the front face 222 being adapted to abut against the front face of the annular shoulder when the full mate condition is achieved.

Preferably and in accord with this invention, the coupling nut comprises generally cylindrical first and second coupling sleeves 320, 330 immovably secured together to define adjacent the radial flange 326 a plurality of support housings 333 for mounting a like number of spring members 340 by means of a support wire 350.

Figure 2:
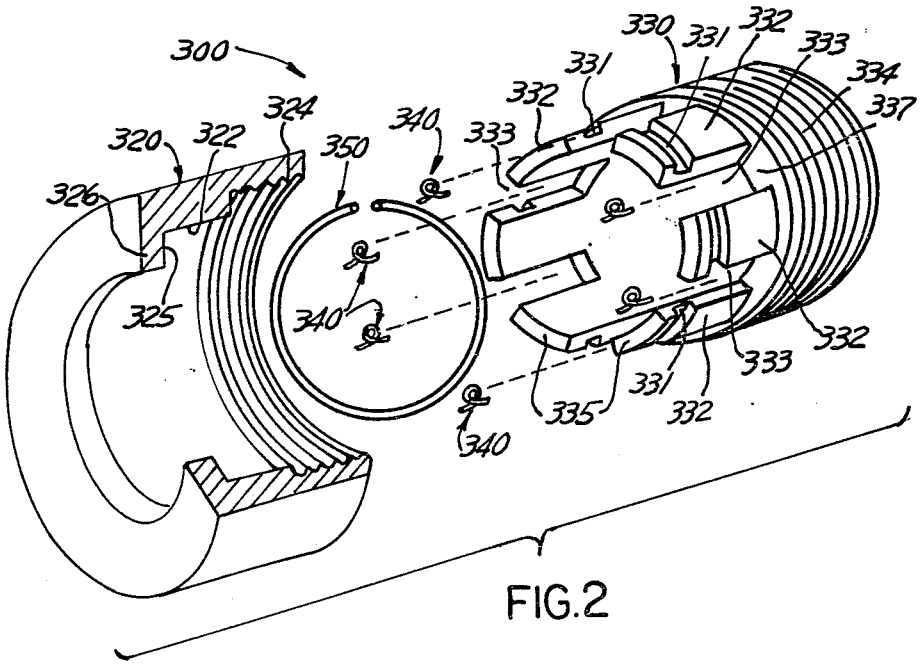
FIG. 2 is an exploded cutaway view partially in section of a coupling nut according to the present invention.

FIG. 2 shows the coupling nut 300 according to this invention in an exploded relationship. The first coupling sleeve 320 comprises the radial flange 326 defining an interior end wall 325 and includes an annular inner wall 322 and a forward internal thread portion 324. The second coupling sleeve 330 comprises an external thread portion 334 and a plurality of elongated longitudinal support brackets 332 extending generally equiangularly from a rear end face 337 thereof, the support brackets each being spaced apart to define therebetween a support housing 333 for receiving one of the spring members 340. Each support bracket 332 includes an annular support groove 331 extending therearound with each of the respective support grooves 331 being aligned to form a continuous trough for receiving the support wire 350. An end face 335 of each support bracket generally is adapted to abut against end wall 325 of the radial flange when the two thread portions 324, 334 are engaged. Either by heat staking or crimping the thread portions are adapted to be immovably non-rotatable once the assembly of the coupling nut has been completed.

As shown, the support wire 350 comprises a uniform wire of circular cross-section being formed into a circular ring and adapted to snugly fit within the respective support grooves 331. The ends thereof would preferably be joined at the final assembly.

Each of the spring members 340 are shown as comprising a looped member defining a central aperture for receiving the spring wire.

Figure 3:
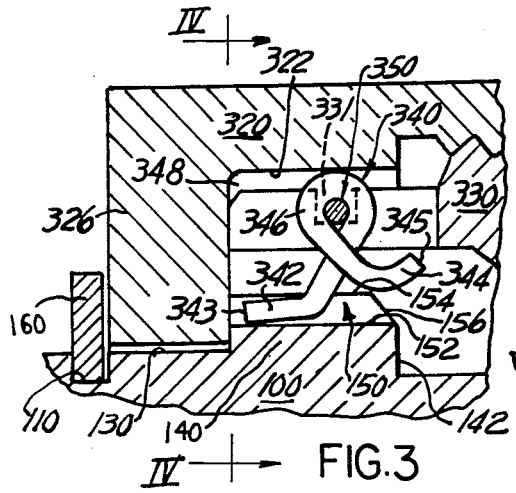
FIG. 3 is an enlarged partial sideview taken of along lines III—III of FIG. 1, partially in section, of the coupling nut and its connector shell prior to assembly.

FIG. 3 is an enlarged view similar to FIG. 1 showing an annular cavity 348 being formed between inner wall 322 and ratchet teeth 150, a spring member 340 disposed within a support housing 333 and the support wire 350 disposed within the support groove 331. The support brackets 332 position the spring members 340 in annular cavity 348 intermediate inner wall 322 and ratchet teeth 150 and circumjacent the peaks and valleys 154, 152 about the radial shoulder 140.

Spring member 340 comprises intermediate oppositely extending first and second hooked end portions 342, 344 thereof an apertured support 346 sized to receive the support wire 350 therethrough, the first hooked end portion 342 including a straight end portion and disposed for engagement within successive valleys 152 of the ratchet teeth 150 and the second hooked end portion 344 including a curved end portion disposed forwardly of tapered face 156 to be normally out of engagement with the ratchet teeth and adapted to be engaged by the front face 222 of the second shell 200 when full mate is achieved.

Figure 4:
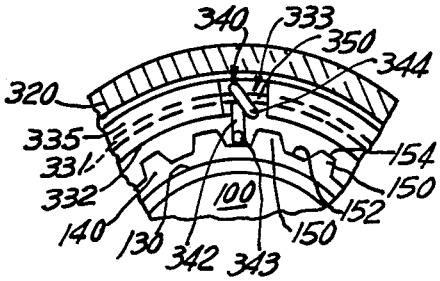
FIG. 4 is an end view taken along lines IV—IV of FIG. 3.

FIG. 4 is an end view of one spring member prior to achieving a full mate coupled relation.

Figure 5:
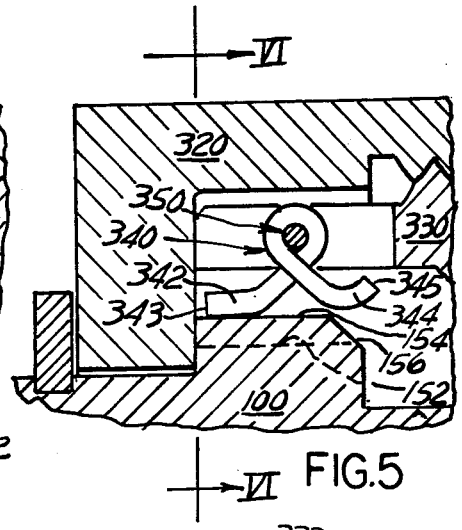
FIG. 5 is an enlarged partial side view, partially in section and similar to FIG. 3, wherein the coupling nut has been rotated relative to the connector shell.

FIG. 5 shows a position where the coupling nut 300 has been is rotated relative to the first shell 100 resulting in the first hooked end portion 342 flopping or laterally swaying upwardly from a valley 152 and over the peak 154 of one successive tooth 150 from a valley 152. The second hooked end portion is out of engagement with the ratchet teeth.

Figure 6:
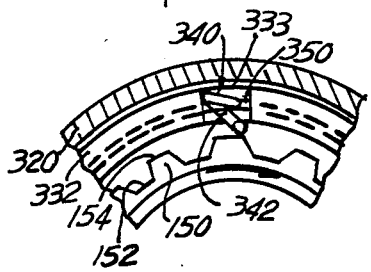
FIG. 6 is an end view taken along lines VI—VI of FIG. 5.

FIG. 6 shows an end view of the rotation of coupling nut 300 prior to full mate wherein spring member 340 is permitted to flop laterally within its spring housing 333 relative to the support wire 350 and move from ratchet peak-valley 154, 152 to succeeding peak-valley 154, 152.

Figure 7:
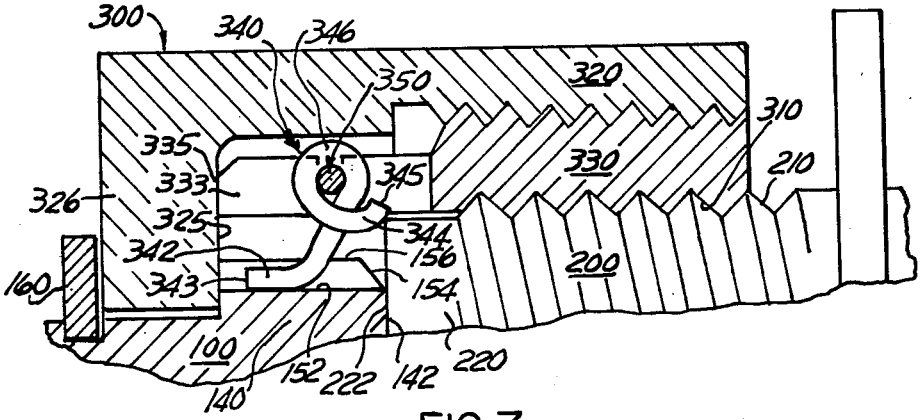
FIG. 7 illustrates a full mate condition between an electrical connector assembly.

FIG. 7 shows a full mate relationship where front face 222 of the second shell 200 is in abutment with the front face 142 of the radial shoulder 140 on the first shell 100 and the front face 222 of the second shell 200 has engaged the second hooked end portion 344 of the spring member 340 and the first hooked end portion 342 of the spring member has been driven downwardly into a valley 152 of one of the ratchet teeth 150. End 345 of the second hooked end portion is driven upwardly and end 343 of the first hooked end portion is compressed into the valley.

Although the description of this invention has been given with reference to a particular embodiment, it is not to be constructed in any limiting sense. Many variations and modifications may occur to those skilled in the art.

We claim:

1. An electrical connector assembly having an anti-decoupling device comprising: first and second shells (100, 200) having front faces (122, 222) with said first shell (100) including on an outside portion thereof a plurality of radially extending ratchet teeth (150) forming a contiguous succession of longitudinal peaks and valleys (152, 154); a coupling nut (300) having an end wall (325) rotatably mounted to said first shell (100) and including first thread (310) connectable with corresponding second thread (210) on an outside portion of said second shell (200) for interconnecting the shells (100, 200); and an anti-decoupling device for retarding rotation of the coupling nut relative to said connector assembly, said anti-decoupling device characterized by: a looped spring member (340) including an apertured support portion (346) intermediate oppositely extending first and second hooked end portions (342, 344), the first hooked end portion (342) being disposed for engagement within successive valleys (152) of the ratchet teeth and said second hooked end portion (344) being disposed to be normally out of engagement with the ratchet teeth and adapted to be engaged by the front face (222) of said second shell (200) when a full mate condition is achieved.

2. The electrical connector assembly as recited in claim 1, wherein said hooked end portions (342, 344) are oppositely extending from their attachment to said support portion (346) and longitudinally disposed relative to the ratchet teeth.

3. An electrical connector assembly as recited in claim 1 wherein an annular cavity (348) is formed between an inner wall (322) of the coupling nut (300) and the ratchet teeth (150), further characterized by a support housing (333) sized to receive said looped spring member (340) being interposed in said annular cavity.

4. An electrical connector assembly as recited in claim 3, wherein a plurality of like looped spring members (340) and associated support housings (333) are interposed in said annular cavity.

5. An electrical connector assembly as recited in claim 4, wherein said coupling nut (300) comprises first and second coupling sleeves (320, 330) immovably secured together and a plurality of equiangularly spaced support brackets (332) extending longitudinally from said second coupling sleeve (330), the spacing between adjacent support brackets defining each support housing (333).

6. An electrical connector assembly as recited in claim 5, characterized by means (331, 350) for pivotally supporting the spring members, said support means comprising a support wire (350) and each support bracket (332) having a support groove (331), each support groove being angularly aligned and adapted to receive support wire (350) therein for mounting the spring members.

7. An anti-decoupling device for an electrical connector assembly of the type including first and second cylindrical connector shells (100, 200) and a coupling nut (300), the first connector shell (100) including a plurality of ratchet teeth (150) arranged annularly thereabout such that the teeth have their flanks extending longitudinally and their peaks extending radially outwardly and around said first shell, said second shell having a front face (222) and including external thread (210) on the outside surface thereof, and said coupling nut (300) including a coupling sleeve (330) rotatably mounted to said first shell (100) and provided with internal thread (310) adapted to engage the external thread (210) disposed on the second shell (200) so that engagement between the threads (210, 310) and rotation of the coupling nut in one direction draws the shells together, said anti-decoupling device characterized by:

a plurality of angularly spaced supports (332) secured to said coupling nut and disposed about the ratchet teeth, each said support (332) including an annular support groove (331) with each adjacent pair of supports (332) defining a longitudinal slot (333) therebetween;

an annular wire (350) extending around said supports (332) and disposed in each said support groove (331); and a plurality of apertured spring members (340), each spring member being pivotally mounted to the wire (350) and received within one of the respective ratchet teeth, each said spring member having a straight end portion (344) adapted to register with each successive ratchet tooth prior to full mating and a curved end portion (342) adapted to cam the straight end portion (344) downwardly and into a longitudinal valley of the ratchet teeth as front face (222) of the second shell achieves full mate.

8. A coupling nut for an electrical connector assembly of the type including a pair of cylindrical shells (100, 200) adapted to have their forward faces (122, 222) telescopically interfitted for mating, the coupling nut being mounted for rotation against a radial flange (140) on the first shell having first thread (310) adapted to engage second thread (210) on the second shell (200) for drawing the second shell forward face (222) toward the flange (140), said flange (140) including a plurality of longitudinal ratchet teeth (150) therearound, said coupling nut comprising: at least one apertured spring member (340) having a straight end portion (342) and a curved end portion (344) and a wire (350) secured to the coupling nut and extending through the aperture, the spring member being pivotally mounted to the wire with the straight end portion (342) being adapted to engage successive of the ratchet teeth and the curved end portion (344) being adapted to engage forward face (222) of the second shell, engagement of the curved end portion (344) by the forward face (222) driving the straightened portion (342) into a ratchet tooth.

9. The coupling nut as recited in claim 8, wherein a pair of supports (322) extend longitudinally from the coupling nut to define a support housing (333) therebetween for protectively mounting spring member (340) therewithin.

10. The coupling nut as recited in claim 8, wherein a plurality of supports (332) extend longitudinally from the coupling nut to define a plurality a support housings (333), a support groove (331) is disposed on each support (332) and sized to receive said wire (350) and a spring member (340) disposed in each support housing, said wire (350) forming a loop extending from support to support to provide a common pivotal securement to each spring member.

* * * * *